United States Patent [19]

Sato et al.

[11] 4,424,660

[45] Jan. 10, 1984

[54] APPARATUS FOR BINDING PAPER SHEETS

[75] Inventors: Koji Sato, Hiratsuka; Tadao Kato, Naka; Hikaru Kawano, Ashigara-kami, all of Japan

[73] Assignees: Musashi Co., Ltd., Tokyo; Hitachi Denshi Engineering Kabushik Kaisha, Kanagawa, both of Japan

[21] Appl. No.: 269,656

[22] Filed: Jun. 2, 1981

[30] Foreign Application Priority Data

Jun. 18, 1980 [JP] Japan ..... 55-81372

[51] Int. Cl.[3] ..... B65B 35/50; B65B 13/12

[52] U.S. Cl. ..... 53/540; 53/542; 53/588; 414/38; 414/103

[58] Field of Search ..... 53/540, 542, 588, 593; 271/213, 214, 221; 414/38, 104, 103, 109

[56] References Cited

U.S. PATENT DOCUMENTS

| | | | |
|---|---|---|---|
| 1,448,301 | 3/1923 | Hotchkiss | 271/221 |
| 2,612,737 | 10/1952 | Thielens | 53/593 X |
| 2,797,098 | 6/1957 | Brodie | 414/109 X |
| 3,019,886 | 2/1962 | Winkler | 53/542 X |
| 3,139,278 | 6/1964 | Maidment | 414/103 X |
| 3,420,149 | 1/1969 | Middleditch | 271/214 X |
| 3,608,269 | 9/1971 | Gore | 53/542 X |
| 3,630,515 | 12/1971 | Knapp | 271/221 X |
| 3,777,906 | 12/1973 | Stolzman | 414/38 X |
| 3,876,083 | 4/1975 | Evans | 414/38 X |
| 4,053,066 | 10/1977 | Lynch | 53/542 X |
| 4,103,786 | 8/1978 | Tokuno | 271/214 X |
| 4,111,116 | 9/1978 | Ito | 53/586 X |

FOREIGN PATENT DOCUMENTS

| | | | |
|---|---|---|---|
| 939288 | 10/1963 | United Kingdom | 271/88 |
| 1020365 | 2/1966 | United Kingdom | 271/214 |
| 1303135 | 1/1973 | United Kingdom | 271/214 |

*Primary Examiner*—John Sipos

*Attorney, Agent, or Firm*—Wenderoth, Lind & Ponack

[57] ABSTRACT

An apparatus for binding paper sheets stacked within a hopper into bundles each consisting of a predetermined number of paper sheets is disclosed. The apparatus comprises a separating drum receiving the paper sheets from the hopper and feeding them out by one, a counter counting the number of paper sheets fed from the separating drum, and a stacker capable of moving between a sheet receiving and a sheet discharging position. When the stacker in the sheet receiving position receives the predetermined number of paper sheets, it is moved to the sheet discharging position and the paper sheets therein are discharged onto support blocks of a binding unit by a transfer device. The binding unit binds the predetermined number of the paper sheets into a bundle with a tape, and a stamping device stamps predetermined particulars on the tape wound around the paper sheets.

3 Claims, 4 Drawing Figures

APPARATUS FOR BINDING PAPER SHEETS

BACKGROUND OF THE INVENTION

This invention relates to an apparatus for binding paper sheets, such as paper money, in bundles.

Although not shown in the drawings, a conventional binding apparatus can not accomplish the whole binding process fully automatically, and a smooth binding operation is not carried out, so that there is the fear that some of the paper sheets will be undesirably scattered, lost or extracted from the stack of paper sheets during the binding operation. Such a problem has to be avoided especially where the paper sheets to be bound are paper money.

It is therefore a principal object of this invention to provide an apparatus for binding paper sheets in bundles which can very effectively remove the above disadvantage of the conventional binding apparatus.

SUMMARY OF THE INVENTION

With the above object in mind, this invention resides in an apparatus for binding paper sheets stacked within a hopper into bundles each consisting of a predetermined number of paper sheets: said apparatus comprising a separating drum positioned near said hopper to receive the paper sheets therefrom and to feed them out one by one; belt means arranged near said separating drum for receiving and feeding out the paper sheets fed from said separating drum; means disposed in the vinicity of said belt means for counting the number of paper sheets fed by said belt means; a stacker disposed on the discharge side of said belt means so as to be capable of moving between a sheet receiving position and a sheet discharging position, said stacker being moved to the sheet discharging position after having received the predetermined number of the paper sheets counted by said counting means; means for transferring the paper sheets disposed on said stacker in the sheet discharging position; a binding mechanism including support means for receiving thereon the paper sheets transferred by said transferring means from said stacker, said support means being stationary and substantially flush with the bottom of said stacker, and a flyer disposed about said support means and rotatable with a tape to bind the predetermined number of the paper sheets on said support means; means disposed near said flyer for stamping predetermined particulars on the tape wound around the paper sheets; and means for discharging the stamped, bound paper sheets on said support means out of said binding unit.

BRIEF DESCRIPTION OF THE DRAWINGS

This invention will become readily apparent from the following description of an exemplary embodiment thereof taken in conjunction with the accompanying drawings, in which.

DESCRIPTION OF THE PREFERRED EMBODIMENT

Figure 1:
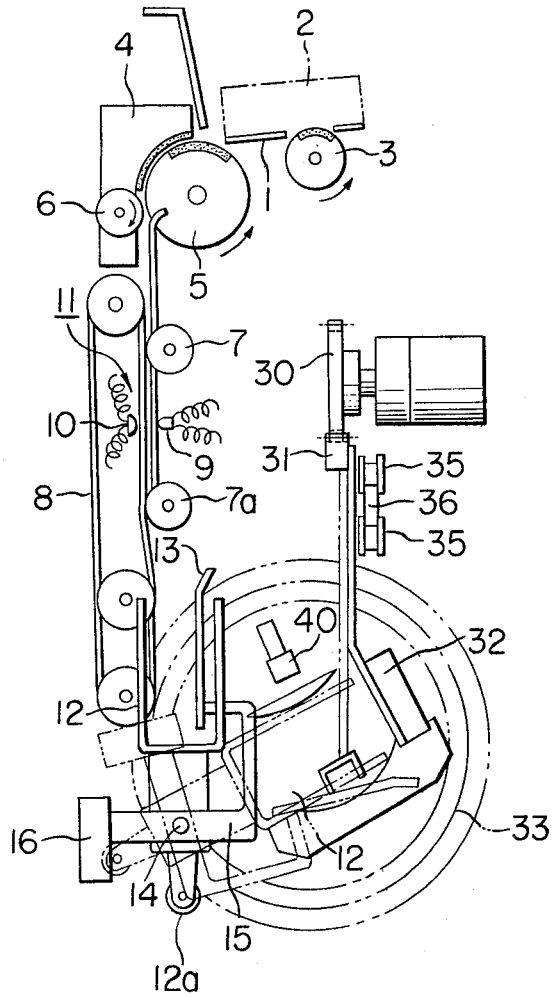
FIG. 1 is a side elevational view of a binding apparatus according to this invention.

Referring to FIG. 1, there is shown a binding apparatus according to this invention, which comprises a hopper 1 for carrying a pile of paper sheets 2 (e.g., paper money), and an auxiliary roller 3 disposed below the hopper 1 for rotation in the direction show by the arrow to feed out the paper sheets 2 one by one. Disposed adjacent to the hopper 1 is a sheet separating unit comprising a stationary, reversed "J"-shaped guide block 4 and a rotatable separating drum 5. The sheet separating unit receives the sheets 2 fed one by one from the hopper 1 and separates them from each other in a known manner so that the sheets 2 are fed separately to the succeeding part of the apparatus in cooperation with a rotary guide roller 6 attached to the guide block 4.

Figure 2:
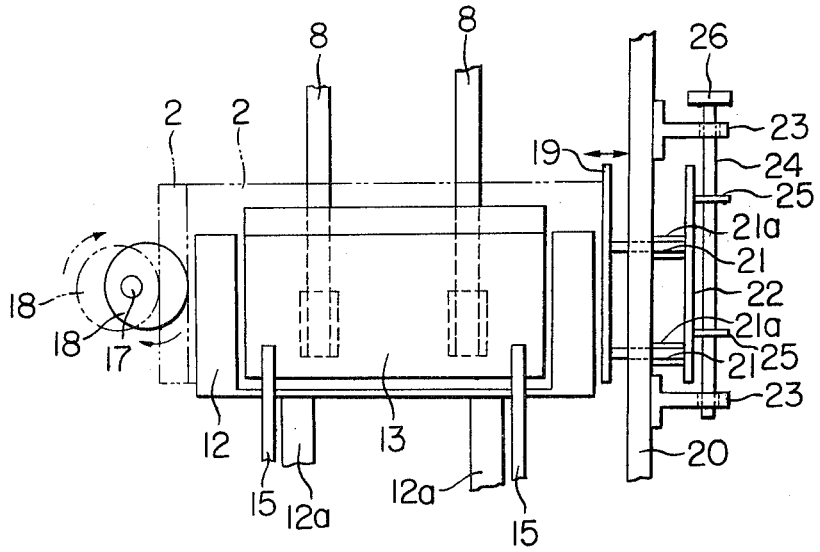
FIG. 2 is a diagrammatic plan view showing the essential parts of the binding apparatus.

Disposed below the separating unit is a sheet feed mechanism comprising a pair of vertically extending feed belts 8 (as best shown in FIG. 2) carried for rotation in a known manner, and feed rollers 7, *7a* (two for each belt) held in contact with the associated feed belts 8. Thus, it will be understood that each paper sheet 2 fed from the guide roller 6 passes through the feed mechanism while sandwiched between the belts 8 and the feed rollers 7, *7a*. Between the upper and lower feed rollers 7 and *7a*, there is a well known optical sheet detecting unit 11 comprising a light emitter 9 and a light receiver 10, between which each sheet travels downwardly in the sandwiched condition. This detecting unit 11 counts the number of paper sheets 2 in a known manner.

Positioned near the lower ends of the feed belts 8 is a stacker 12 (movable between sheet receiving and discharging positions), in which a pressure plate 13 is set. Since each lower feed roller *7a* pushes the downward run of the feed belt 8 toward the upward run thereof as shown in FIG. 1, the paper sheets 2 are fed while changing the feed direction thereof at the position of the lower feed rollers *7a* and piled up into the stacker 12. The pressure plate 13 is connected to one end of an L-shaped lever 15 pivotably supported by a pin 14, and a counterweight 16 is attached to the other end of the lever 15, so that the pressure plate 13 is always urged toward the feed belts 8 and therefore presses the paper sheets 2 against the feed belts 8.

Figure 4:
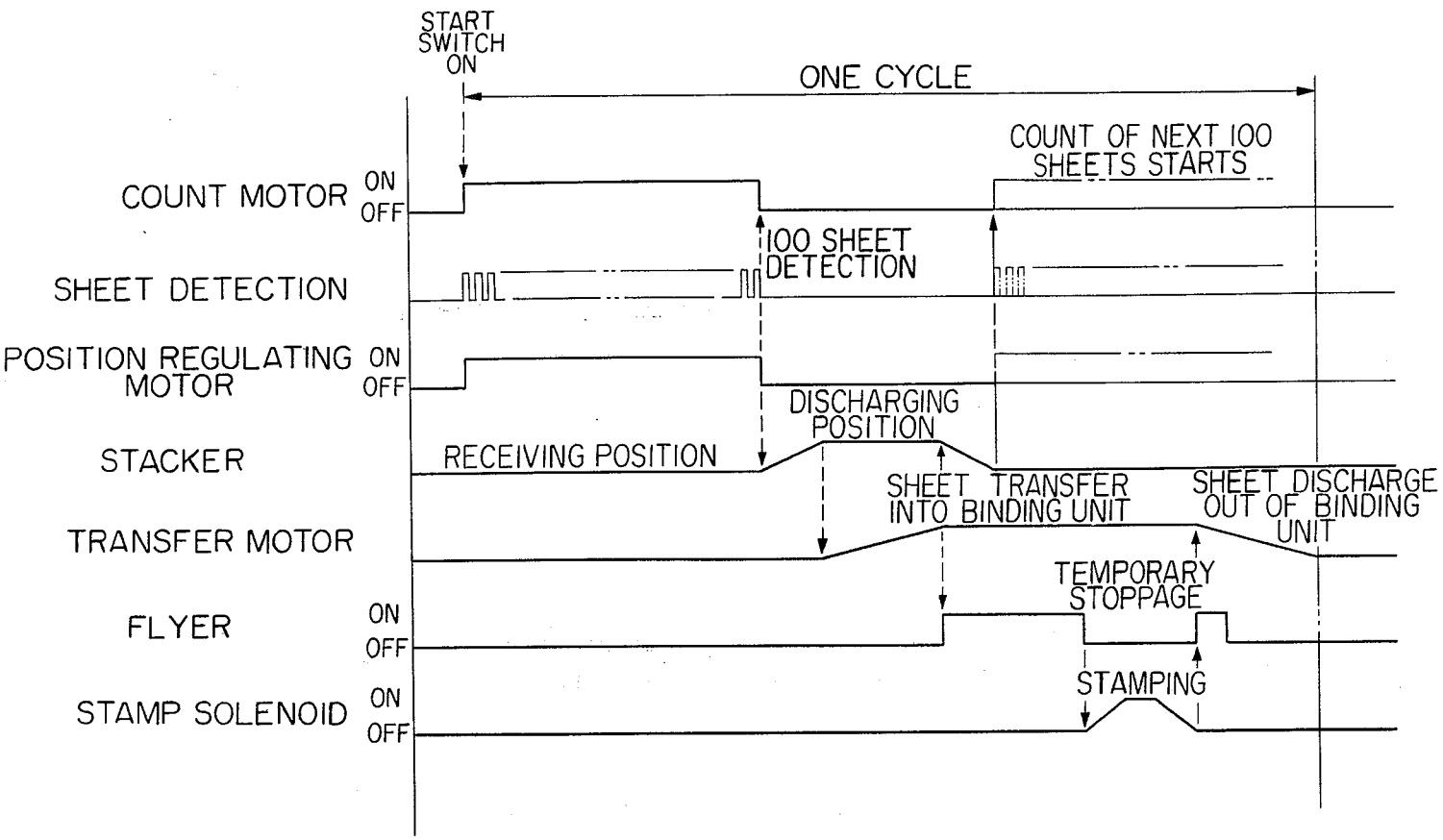
FIG. 4 is a timing chart showing the operation timing of various elements of the binding apparatus.

As shown in FIG. 2, the paper sheets 2 are arranged side by side with each other on the bottom of the stacker 12 with one of their short sides being pressed against a guide plate 19 by an offset drum 18 positioned at the other short side of the paper sheets 2 and rotatable in the direction of the arrow about a support pin 17 connected to a not shown position regulating motor (FIG. 4), and with their lower long side being pressed against the bottom of the stacker 12 by the downward run of the feed belt 8. Thus, the stack of paper sheets 2 on the stacker 12 is neat.

The position of the guide plate 19 is designed to be capable of being regulated according to the size of paper sheets. For example, where the paper sheets are paper money, the guide plate 19 is regulated in accordance with the denomination of paper money. For this purpose, the guide plate 19 is supported by the one ends of slide bars 21 extending through a framework 20 and connected at the other ends to a pusher plate 22. The framework 20 is provided with spaced stays 23 through which a cam shaft 24 loosely extends so that it can rotate in the stays 23. A pair of guide cams 25 is fitted onto the cam shaft 24 and a knob 26 is fixedly attached to the end of the cam shaft 24 as illustrated in FIG. 2. Furthermore, spring means 21*a*, such as a coil spring, is disposed around part of each slide bar 21 between the framework 20 and the pusher plate 22 to bias the pusher plate 22 against the guide cams 25, thereby setting the guide plate 19 in a desired position. Thus, it can be understood that the position of the guide plate 19 is adjusted in the direction of the arrow by rotating the cam shaft 24 and accordingly the guide cams 25 with the knob 26.

Figure 3:
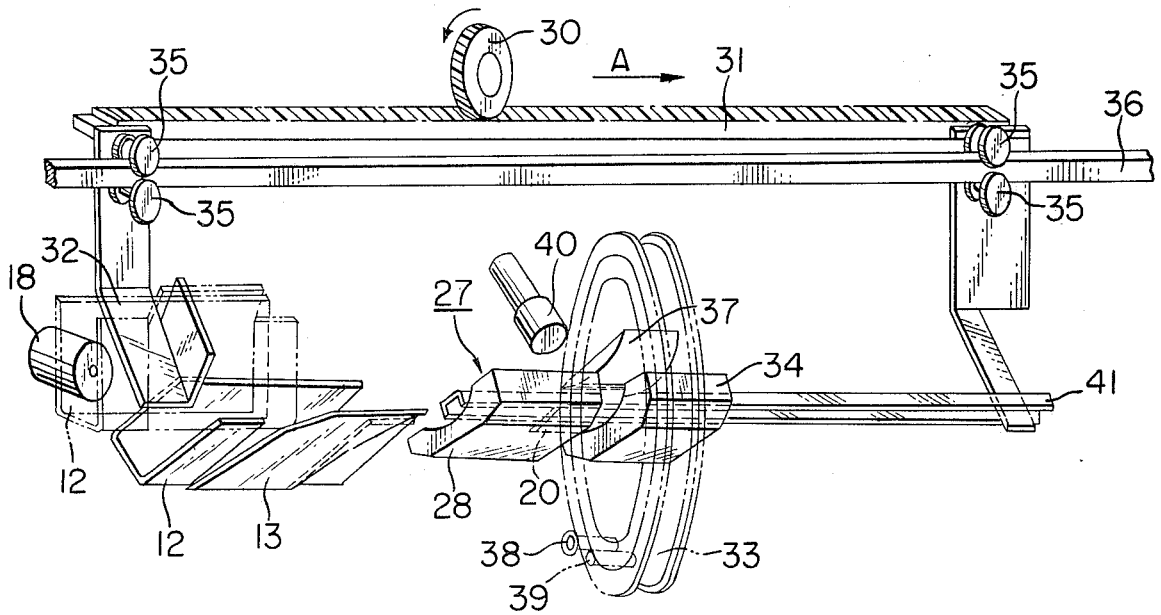
FIG. 3 is a diagrammatic perspective view of a mechanism for transferring a fixed number of paper sheets into a predetermined position in a flyer.

When the number of paper sheets 2 received in the stacker 12 reaches a fixed number (e.g., 100), the detecting unit 11 supplies a signal to a not shown stacker turning means, such as a solenoid or motor driven cam, which causes stacker supporting arms 12*a* to be rotated about the pin 14 until the stacker 12 turns a predetermined angle corresponding to the angle of inclination of a support block 28 in a binding mechanism 27 (FIG. 3). At this time, the pressure plate 13 is moved out of the stacker 12, as shown by the dotted line in FIG. 1, by the weight of the pressure plate 13 itself and the movement of the centroid of the counterweight 16. When the stacker 12 rotates the above-mentioned angle into the sheet discharge position, a not shown detector, such as a limit switch or a photoelectric tube, generates a signal to cause a pinion 30 driven by a transfer motor 30*a* (FIG. 1) to rotate in the counterclockwise direction to thereby move a rack 31 in the direction A. By this means, a transfer arm 32 carried by the rack 31 also moves in the direction A and causes the paper sheets 2 in the inclined stacker 12 to be transferred onto the support blocks 28 and 34 of the binding mechanism 27. At each of the opposite ends of the transfer rack 31 there is a pair of guide rollers 35, between which an elongated guide rail 36 extends to assist the guide rollers 35 in moving linearly therealong.

Regarding the binding mechanism 27, reference is made to U.S. Pat. Nos. 4,111,116; 4,117,650; 4,126,982; and 4,126,983; all assigned to the same assignees as the present application.

When the paper sheets 2 reach a predetermined position on the support blocks 28 and 34, a not shown detecting means, such as a limit switch or a photoelectric tube, detects the predetermined position of the paper sheets 2 and generates a signal to cause the following steps to be performed while the paper sheets 2 are being bound by the flyer 33. The arms 12*a* and 15 for changing the angular positions of the stacker 12 and pressure plate 13 are rotated about the common center shaft 14 by the not shown solenoid or motor driven cam and cause the stacker 12 to return to the initial position for receiving the paper sheets transferred by the feed belts 8. The return of the stacker 12 is detected by a not shown detecting means, such as a limit switch or a photoelectric tube, which generates a signal to start the feed out of the paper sheets 2 from the hopper 1 and the counting of the number of fed paper sheets. At the same time that the paper sheets 2 reach the predetermined position on the support blocks 28 and 34, the binding mechanism 27 initiates the binding operation in the manner described, e.g., in the above-mentioned U.S. Pat. No. 4,111,116. In brief, a clamping plate 37 moves down to compress the paper sheets 2 on the support blocks 28 and 34, while at the same time the flyer 33 rotates with the end of a not shown binding tape being held between a pair of pins 38 and 39 mounted to the flyer 33 in a manner allowing the relative movement thereof. Thus, the paper sheets 2 are firmly bound into a bundle.

A stamping unit 40 is disposed adjacent the upper part of the flyer 33 to stamp required particulars on the tape binding the paper sheets 2 when it is actuated with a not shown actuating means, such as a solenoid, or a cam. The stamping is carried out during the temporary stoppage of the flyer 33 at a position in which the face of the tape becomes parallel to the stamping side of the stamp 40. Simultaneously with the completion of the stamping, the transfer pinion 30 rotates in the clockwise direction to move the transfer rack 31 in the direction opposite to the arrow A, whereby a discharge arm 41 attached to the rack 31 moves in the same direction and discharges the stamped, bound paper sheets 2 from the binding unit 27.

It is therefore understood that the binding apparatus according to this invention can bind paper sheets (e.g., paper money) so as to continuously provide paper sheets bundles, each consisting of a fixed number of paper sheets and having a neat shape, fully automatically and without manual labor. Thus, this invention prevents some paper sheets from being scattered, extracted and lost during the binding operation.

What we claim is:

1. An apparatus for binding paper sheets stacked in a stack into bundles each consisting of a predetermined number of sheets, said apparatus comprising:

a hopper for holding the stack of sheets and a feeder roller in the bottom thereof for feeding sheets from the bottom of the stack;

a separating drum positioned adjacent said hopper to receive the paper sheets fed therefrom and to separate them and feed them out one by one;

belt means adjacent said separating drum for receiving the paper sheets fed from said separating drum and conveying them in a vertical path;

a counter positioned along said belt means and past which the paper sheets are conveyed by said belt means for counting the number of sheets conveyed;

a stacker disposed at the bottom end of said belt means at the discharge end thereof, said stacker having an open top through which the paper sheets are fed thereinto, a closed bottom on which the paper sheets are disposed on edge, spaced opposed sides, one of which has an opening therein, and open ends at the opposite ends of said sides;

means for pivoting said stacker about a horizontal pivot for movement between an upright sheet receiving position with the open end at the upper end thereof, and a generally horizontal sheet discharging position in which said stacker has the one side with said opening therein facing downwardly and the open top facing generally sideways;

a pressure plate movable into said stacker through said opening for pressing the paper sheets against the other side of said stacker, a lever pivotally mounted on said stacker and having said pressing plate on one end thereof and a counterweight on the other end;

the moment of said counterweight when said stacker is in the upright position being greater than the moment of said pressure plate, whereby said pressure plate is urged against the sheets being stacked in said stacker, and the moment of said counterweight being less than the moment of said pressure plate when said stacker is in the generally horizontal position, whereby said pressure plate is moved away from the stack of sheets through said opening for causing the stack of sheets to be supported on said one side of said stacker;

means for transferring the paper sheets disposed on said one side of said stacker when said stacker is in the sheet discharging position;

a binding mechanism including a support means for receiving thereon the paper sheets transferrred by said transferring means, said support means being stationary and substantially flush with said one side of said stacker when said stacker is in the sheet discharging position, and a flyer disposed about said support means and rotatable for binding the stack of paper sheets on said support means with a tape;

means positioned adjacent said flyer and movable against said tape and away from said tape for stamping information on the tape; and means for discharging the stamped bound stack of sheets out of said binding mechanism.

2. The apparatus set forth in claim 1, further comprising an offset drum disposed near one open end of said stacker in the sheet receiving position for arranging the paper sheets in order by the rotation of said offset drum, and a plate closing the other open end of said stacker in the sheet receiving position.

3. The apparatus set forth in claim 2, wherein the position of said closing plate is adjustable toward and away from said offset drum.

* * * * *